United States Patent [19]

Guernsey

[11] 4,042,110

[45] Aug. 16, 1977

[54] CARTON DISPLAY DEVICE

[75] Inventor: Richard H. Guernsey, Indianapolis, Ind.

[73] Assignee: Eli Lilly and Company, Indianapolis, Ind.

[21] Appl. No.: 689,275

[22] Filed: May 24, 1976

[51] Int. Cl.[2] ..... G09F 3/00

[52] U.S. Cl. ..... 206/459; 40/313; 206/45.29; 229/39 R; 229/44 R; 229/70

[58] Field of Search ..... 40/312, 313; 229/39 R, 229/17 G, 44 R, 70, 85; 206/45.28, 45.29, 459

[56] References Cited

U.S. PATENT DOCUMENTS

| | | | |
|---|---|---|---|
| 1,116,043 | 11/1914 | Elliott | 229/70 |
| 1,177,886 | 4/1916 | Newcomb | 229/70 |
| 1,242,534 | 10/1917 | Eaton | 229/51 TC |
| 1,412,155 | 4/1922 | Albers | 206/45.29 |
| 1,732,226 | 10/1929 | Darragh | 206/45.28 |
| 2,647,621 | 8/1953 | Bowden | 206/45.29 |
| 2,789,751 | 4/1957 | Feldman | 229/51 TC |
| 2,894,618 | 7/1959 | Matteson | 206/45.28 |
| 2,928,581 | 3/1960 | Graybill | 229/39 R |

FOREIGN PATENT DOCUMENTS

| | | | |
|---|---|---|---|
| 94,095 | 2/1897 | Germany | 229/85 |

*Primary Examiner*—William Price
*Assistant Examiner*—Bruce H. Bernstein
*Attorney, Agent, or Firm*—Houston L. Swenson; Everet F. Smith

[57] ABSTRACT

A paperboard carbon formed from a unitary blank is provided with a display device that may carry various marketing and identifying legends and which can upon purchase be readily removed without destroying the attractiveness of the carton.

4 Claims, 6 Drawing Figures

CARTON DISPLAY DEVICE

BACKGROUND OF THE INVENTION

For a number of years various industries and in particular the liquor industry have placed their products in specially designed containers that are on sale during the holiday season. These containers are generally of paperboard construction and are attractively designed so that they on first glance look like conventional Christmas packages. In most instances it is essential that while the package and product are on sale at the retail level that the package bear indicia which will carry information about the product and perhaps the price of the product. Such information, of course, will want to be removed by the purchaser before he presents his gift to a friend. Thus, easily removed paper bands and other types of display devices that are separate from the general paperboard carton blank have been used. Although these approaches have served the purpose of providing information that can be quickly removed by the purchaser, it has meant that additional costs are incurred since one or more extra steps are required in assembling the carton and the indicia-bearing display.

SUMMARY OF THE INVENTION

It is the purpose of my invention to provide in the form of a single paperboard carton blank a display device that will be capable of bearing sufficient information and yet can be readily removed. In general, this is accomplished by utilizing cartons having an opening that is selectively closed by a cover with a tuck flap. The tuck flap has a portion that is folded back upon itself and which extends downwardly into the interior of the carton. This portion of the tuck flap also has an exterior extension which bears the printed indicia and which is able to lie in the general contour of the carton and held there by means of a small slot in the front wall of the carton. This display device can be readily removed by the purchaser inasmuch as the interior portion of the tuck flap has a weakened area such as a line of perforations which enables one to quickly tear off the display device. The line of perforations is not readily visible to the purchaser and thus does not detract from the overall ornamental appearance of the carton.

DESCRIPTION OF THE PREFERRED EMBODIMENTS

Figure 1:
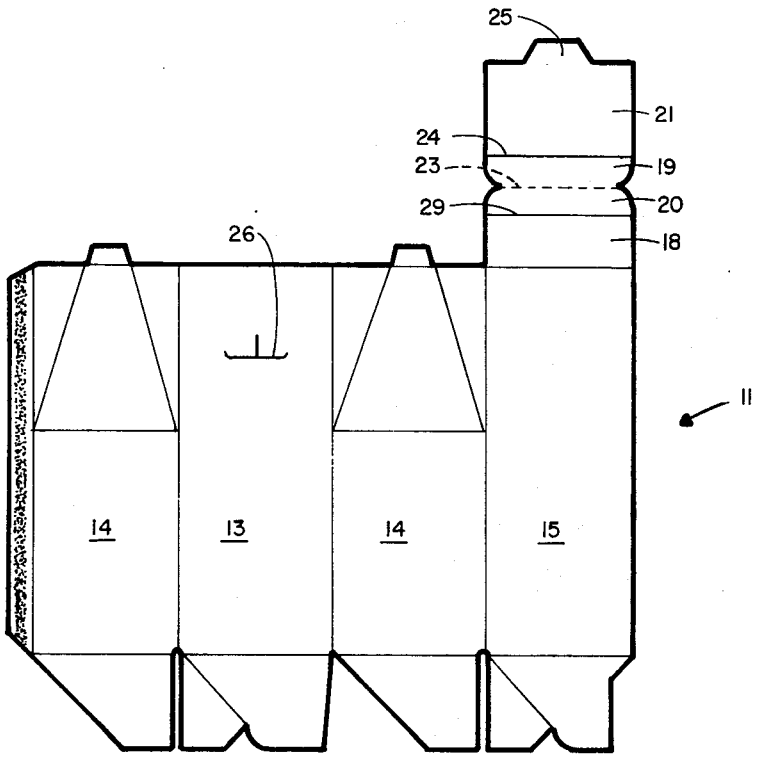
FIG. 1 is a top plan view of a blank that may be folded into the paperboard carton of this invention.
Figure 2:
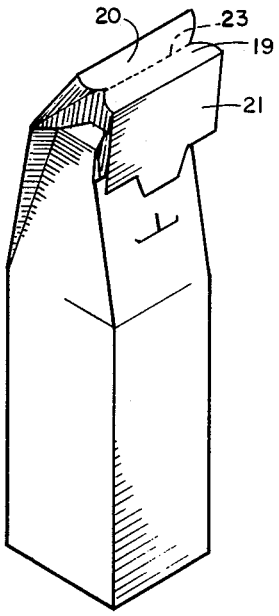
FIG. 2 is a perspective view of the paperboard carton formed from the blank of FIG. 1 and illustrates the cover's tuck flap prior to closing it.
Figure 3:
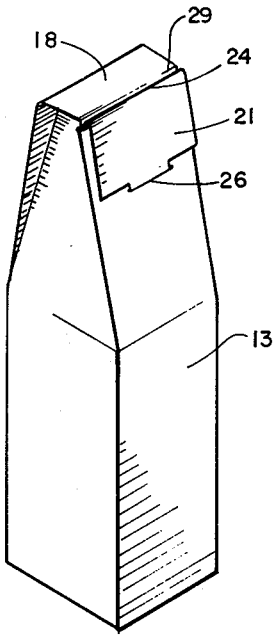
FIG. 3 is a perspective view of the carton of FIG. 2 in its closed position with a display device.

Referring to FIG. 1 where the preferred embodiment is illustrated, it is to be noted that paperboard carton blank 11 has a front wall panel 13, side wall panels 14 and back panel 15. A conventional design of four interlocking flaps 16 form the bottom of the carton. Extending from back panel 15 is a cover panel 18 having a first tuck flap 19 to which is integrally attached a display device comprising panel 21 and a second tuck flap 20. This panel is removably attached to cover 18 by a weakened area comprising crease line 23, which in the preferred embodiment is between tuck flaps 19 and 20. Line 23 may be weakened by perforations or small slits in the paperboard blank. Display device 21, which is fastened to tuck flap 19 by a second crease line 24, has a fastening tab 25 at its free end which will, when assembled, be inserted into a slot 26 on the carton's front panel 13.

It is to be understood that the paperboard blank of FIG. 1 contains various types of ornamental decorations appropriate for the particular season for which it is to be merchandised. Display device panel 21 will bear various sales information of interest to the customer.

In closing the carton after it is filled with a product such as a bottle of liquor, tuck flaps 19 and 20 are folded back against each other in close contact. Thus, the tear crease line 23 is folded as well as crease lines 24 and 29 which define the other sides of the two tuck flaps. As these two tuck flaps are folded against each other and pushed down into the interior of the carton's open neck, the carton becomes closed. Display device panel 21 is then fastened by means of tab 25 into slot 26. This assures that the display device does not become vulnerable to accidental tearing off, a problem that exists for other types of display panels that stand outwardly from the general contour of the carton.

Figure 4:
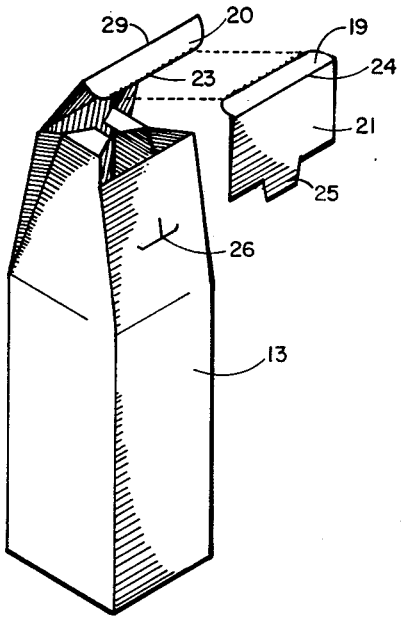
FIG. 4 is a perspective view of the carton illustrating the technique for removing the display device from the tuck flap.
Figure 5:
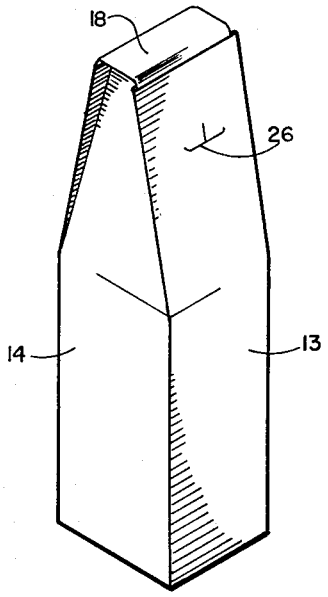
FIG. 5 is a perspective view of the carton without the display device and after it has been reclosed.

Referring to FIG. 4, display device 21 can readily be removed by the purchaser by simply temporarily opening the carton and detaching panel 21 and tuck flap 19 from tuck flap 20. The now broken tear line 23 has a ragged edge which is unattractive. My design overcomes this undesirable feature by incorporating the tear line into the cover which tends to hide the ragged edge. It is to be noted that in my carton, as seen in FIG. 5, the torn tear line 23 is not visible once the carton is reclosed with tuck flap 20 extending into the interior of the carton. Slot 26 on front panel 13 need not be a distraction to the overall appearance of the carton since it can be readily designed into the ornamental make-up of the carton. Although the carton of FIGS. 1 through 5 has a gabled configuration, it is apparent that the principles of my display device can be readily adapted into other configurations including wholly rectangular cartons.

Figure 6:
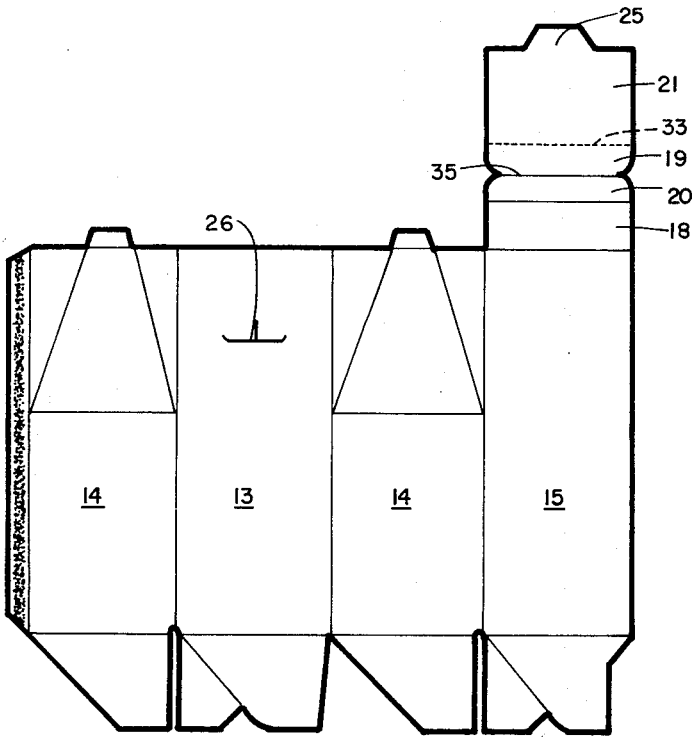
FIG. 6 is a top plan view of a paperboard blank which may be used for forming the second embodiment of my invention.

Referring to the blank of FIG. 6, a modified embodiment of my carton is provided which enables one to remove the display device without first having to open the carton. In this instance tear line 33 becomes the division line between front display device panel 21 and its adjacent tuck flap 19. A crease line 35 divides the two tuck flaps and does not contain perforations that weaken it. Thus, in this embodiment in which the only change from the first embodiment is the transferral of the tear line and the crease line for tuck flap 19, one need only unfasten tab 25 from slot 26 and rip off the display device panel 21 along tear line 33. This avoids the minor inconvenience of having to open the carton in order to remove the display panel although it does mean that the somewhat ragged tear line 33 will be slightly visible at the front edge of the cover panel 18.

I claim:

1. In an integral paperboard carton having a reclosable cover, the improvement comprising a display device panel integrally connected to a first tuck flap with a first crease line therebetween, said first tuck flap being connected by a second crease line to a similar second tuck flap adjacent the carton's cover, and folded against said second tuck flap along said second crease line for insertion into the interior of the carton when said cover is closed, said display device being detachable from said carton by a weakened area in one of said crease lines and having a fastening tab at its free end for removable engagement with a slot in the front wall of the carton to maintain said display device panel flush with the carton's front wall.

2. The improvement in accordance with claim 1 in which said first crease line, with said cover in its closed position, abuts on the top edge of the front wall of the carton.

3. The improvement in accordance with claim 2 in which said first crease line is weakened for detaching said display device and said second tuck flap.

4. The improvement in accordance with claim 2 in which said second crease line is weakened for detaching said display device.

* * * * *